United States Patent [19]

Gallagher

[11] 3,930,705

[45] Jan. 6, 1976

[54] ELECTRICAL CONNECTOR ASSEMBLY

[75] Inventor: David A. Gallagher, Romeoville, Ill.

[73] Assignee: Bunker Ramo Corporation, Oak Brook, Ill.

[22] Filed: Mar. 8, 1974

[21] Appl. No.: 449,422

[52] U.S. Cl...... 339/59 M; 339/66 M; 339/103 M; 339/184 M

[51] Int. Cl.[2]..... H01R 9/04

[58] Field of Search... 339/59 R, 59 M, 60 R, 60 M, 339/61 R, 61 C, 61 M, 65, 66 R, 66 M, 101, 103 R, 103 M, 184 R, 184 M, 185 R; 174/19

[56] References Cited

UNITED STATES PATENTS

| | | | |
|---|---|---|---|
| 2,787,770 | 4/1957 | Arson | 339/184 M |
| 3,167,374 | 1/1965 | Healy | 339/103 R X |
| 3,182,278 | 5/1965 | Bridle | 339/59 M |
| 3,196,382 | 7/1965 | Morello, Jr. | 339/103 R X |
| 3,445,580 | 5/1969 | Lusk | 174/19 X |
| 3,445,804 | 5/1969 | Perkins | 339/66 R X |
| 3,588,784 | 6/1971 | Kynkle et al. | 339/65 |
| 3,676,833 | 7/1962 | Johnson | 339/65 X |

FOREIGN PATENTS OR APPLICATIONS

| | | | |
|---|---|---|---|
| 1,271,272 | 7/1961 | France | 339/60 M |
| 1,804,945 | 11/1969 | Germany | 339/60 R |

*Primary Examiner*—Joseph H. McGlynn
*Assistant Examiner*—Howard N. Goldberg
*Attorney, Agent, or Firm*—D. R. Bair; F. M. Arbuckle

[57] ABSTRACT

The following specification is directed to an electrical connector assembly including a cam surface on one connector body having recessed contacts and a cam follower on the other connector body having recessed contacts for guiding the connector bodies and contacts into proper engagement. Guide means are also provided on the connector bodies for facilely guiding the insertion of a socket contact into one of the bodies and a boot having improved guiding means is used for sealing and gripping the conductors connected to the contacts.

8 Claims, 13 Drawing Figures

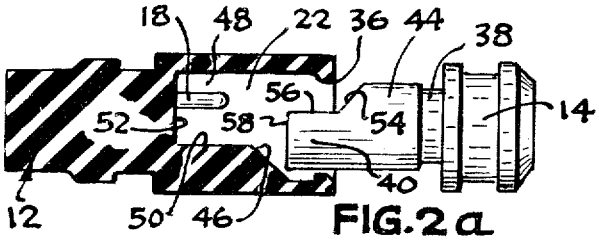
FIG.2a
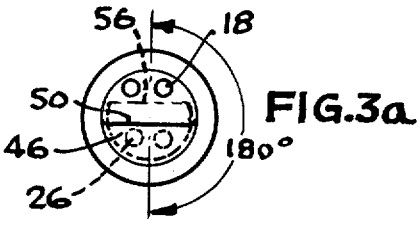
FIG.3a
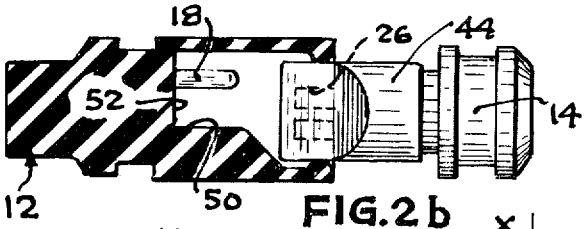
FIG.2b
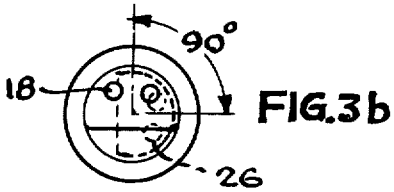
FIG.3b
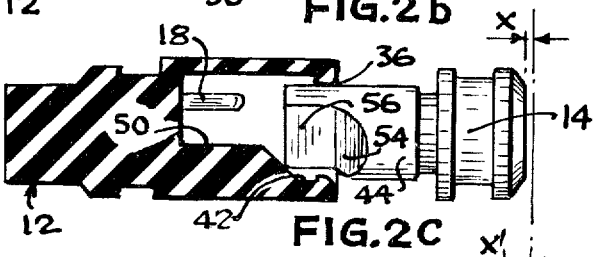
FIG.2c
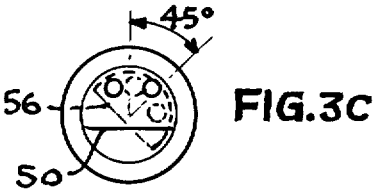
FIG.3c
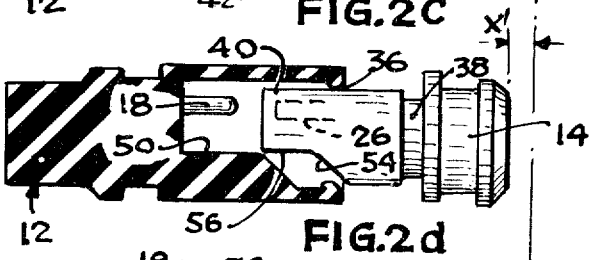
FIG.2d
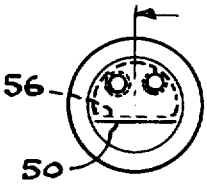
FIG.3d
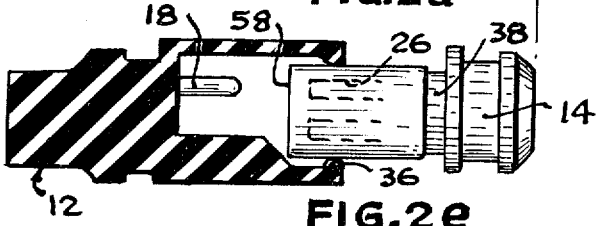
FIG.2e
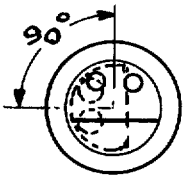
FIG.3e
FIG.1
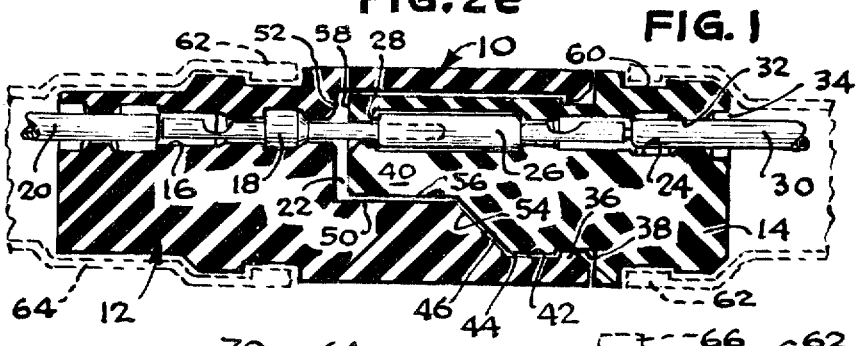
FIG.4
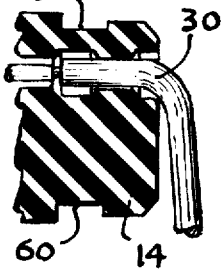
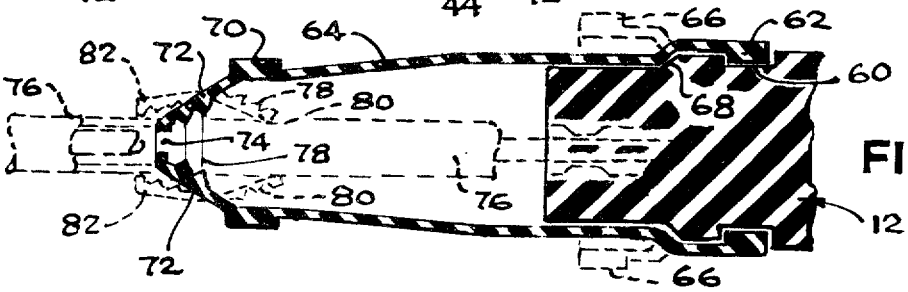
FIG.5

ELECTRICAL CONNECTOR ASSEMBLY

BACKGROUND OF THE INVENTION

1. Field of the Invention

This invention relates in general to electrical connector assemblies and more particularly to improved guide means for components of an electrical connector assembly.

2. Summary of the Prior Art

Electrical connector assemblies often include a pair of pin contacts projecting from one connector body or receptacle member into a blind recess for engagement with a pair of socket contacts recessed in a second connector body or plug member. The plug member is inserted into the blind recess for establishing electrical connections between the contacts. Misalignment of the pin contacts and socket contacts naturally occurs frequently rendering the assembly of the connector bodies difficult and time-consuming.

The socket contacts are inserted into the respective connector body, which is of a relatively hard rubber or other dielectric material, through a riser or small diameter portion at one end of the body. The socket contact has a blunt end or face of larger diameter than the riser and the riser is expanded to receive the socket contact and thereafter form a relatively tight seal therewith. When axial pressure is manually applied to the socket contact to effect entry, small misalignment may result in failure to spread the riser and the socket contact may slip to either cause injury or damage to the connector body and the operator.

To effect connections to the contacts, the ends of several conductors leading to the contacts in the connector body and a jacket in which the conductors are carried must be skinned to enable connection to the contacts. The skinned conductor ends are located in the connector body while the jacket end is usually located adjacent the body and is subject to the entrance of moisture or other contaminants, for example, creating deleterious effects.

SUMMARY OF THE INVENTION

To avoid the afore-described and other problems, the present invention utilizes a guide means formed by simply moulding a cam in the recess of the receptacle member and a cam follower on a projecting end of the plug member fitted in the recess for controlling the angular position of the two members in response to axial pressure therebetween to assure proper alignment of the contacts for facilely and quickly enabling their engagement.

The plug member receiving the receptacle contacts is also provided with a slightly enlarged bore adjacent the riser to provide an initial guide means or guideway for properly guiding the receptacle contact into engagement with the riser or small diameter portion so that it can be easily inserted into the respective connector body and is held from slipping.

An annular boot of soft, pliable or resilient rubber is also provided for the end of the connector body through which the insulated conductors pass and the boot is provided with a small diameter passageway at one conical end spaced from the connector body. The conical portion inverts in response to axial translation to provide a guideway for the conductors and jacket into the small diameter passageway for enabling its enlargement to receive the conductors and their jacket.

The conical portion is then reverted to its original axial position and the edge of the radially enlarged passageway contracts about the conductors. The contracted passageway together with inwardly projecting lips adjacent the passageway insure a tight seal against the entrance of moisture.

It is, therefore, a primary object of the present invention to provide an improved and more economical electrical connector assembly.

Other objects and features of the present invention will become apparent on examination of the following specification and claims together with the drawings.

BRIEF DESCRIPTION OF THE DRAWINGS

FIG. 1 is a sectional view of an electrical connector assembly incorporating the principles of the present invention.

FIGS. 2*a*–2*e* are a series of side elevational views partially in section illustrating the manner in which the guide means on the connector bodies cooperate to guide the contacts into proper alignment.

FIGS. 3*a*–3*e* are a series of largely diagrammatic end views corresponding to FIGS. 2*a*–2*e* respectively illustrating the manner in which the connector bodies are guided into proper alignment.

FIG. 4 is a fragmentary sectional view illustrating the manner in which the socket contact guideway in the connector body also provides strain relief for the conductors.

FIG. 5 is a fragmentary sectional view illustrating the manner in which the boot receives the conductors together with their jacket and protects the multi-conductor cable entering the connector body.

BRIEF DESCRIPTION OF THE PREFERRED EMBODIMENT

Referring to FIG. 1, a connector assembly is indicated generally therein by the reference character 10. The connector assembly includes a generally cylindrical integrally formed one piece body or receptacle member 12 and a generally cylindrical integrally formed one piece body or plug member 14.

The receptacle member 12 has a plurality of longitudinally or axially extending passageways such as 16 through which a respective elongate pin contact such as 18 extends. Each pin contact 18 has an insulated conductor 20 secured thereto adjacent the rear or one end and projects at the other pin contact end into a generally cylindrical recess 22 formed by a generally annular wall encircling recess 22 at the front end of the receptacle member with the contacts 18 terminated at a position spaced axially or recessed from the front end of recess 22.

The plug member 14 has a plurality of longitudinally or axially extending passageways such as 24 therein which receive a respective elongate socket contact 26 having a tubular end for receiving a respective pin contact 18. The socket contact 26 has a flat end face 28 encircling the tubular openings and recessed in body 14. Face 28 is generally perpendicular to the axis of the contact and body and receipt of a respective one of pin contacts 18 in the tubular end of contact 26 establishes an electrical connection between conductor 20 and a respective conductor 30 connected to the other end of each socket contact 26.

It will be noted that each passageway 16 and 24 has a large diameter intermediate its ends with a small diameter portion or riser portion 32 adjacent opposite ends of each passageway. The small diameter portions or risers form seals for the conductors and contacts to prevent the entrance of moisture or other contaminants. In the case of the pin contact, insertion into its respective passageway presents little difficulty since it has a rather small diameter conical pin end portion permitting manual guidance through the small diameter riser portion without difficulty. The receptacle contact, on the other hand, is provided with a relatively large diameter flat or transverse end face 28, which if pressed against the riser portion at the very end of the respective body, would tend to slip therefrom if not accurately aligned. To provide guiding and alignment means, a guideway comprising an enlarged diameter bore or recess 34 coaxial with the passageway 24 is formed at the rear end of the plug 14 and the passageway 24 behind riser 32. This enlarged diameter portion 34 permits the face 28 on the socket contact 26 to be accurately aligned with the opening through the riser 32 and prevents slippage therefrom since it confines the adjacent socket contact end. After the face 28 passes through the enlarged diameter portion 34 which is sized to engage the peripheral contact surface to align the contact with the reduced diameter portion 32, the contact passes through portion 32 and a second reduced diameter portion with reduced diameter portions 32 and 34 assisting in thereafter maintaining alignment of the contact 26 for movement into the enlarged diameter portion of the passageway 24 in which the contact finally seats.

As seen in FIG. 4, if the wire or conductor 30, for example, is conveniently engaged with the passageway 24 from a position extending transversely or at right angles to the passageway axis, the rear edge of recess 34 provides a support or strain relief for the conductor and riser 32.

The internal surface of the annular wall defining the cavity or recess 22 in the front end of receptacle member 12 has an annular or radially inwardly extending lip 36 at the front end of the recess for engaging or snap-fit engagement in a corresponding recess 38 in the external periphery of the plug member 14 in response to the correct insertion and alignment of a generally cylindrical front end projection 40 on plug member 14 in recess 22. The recess 22 has a first or a front enlarged axially extending annular internal surface portion 42 directly behind the lip 36 for receiving a similarly shaped and dimensioned cylindrical surface portion 44 on the projecting end of plug member 14 directly in front of recess 38, if the members are properly aligned. A ramp or cam surface portion 46 is formed directly behind portion 42 at substantially 45° to the longitudinal axis of member 12 and offset from the axis of member 12. Cam surface 46 extends rearwardly from surface portion 42 to a position intermediate the ends of recess 22 to thereby substantially reduce the cross-sectional area of the recess 22, which is otherwise annular in the corresponding axial portions. A last reduced recess portion 48 is formed above and directly to the rear of the cam 46 by an axially extending flat guide surface portion 50 connecting cam portion 46 with a radial end face 52 of the recess 22 and from which pin contacts 18 project.

The projection 40 on plug member 14 is also provided with a ramp surface portion 54 of similar length and width to cam 46 and extending at substantially 45° to the longitudinal axis of the member 14 and offset therefrom. The ramp portion 54 extends into a flat surface portion 56 similar in length and width to portion 50 and parallel to the longitudinal axis of member 14. Surface portion 56 intersects a flat radial front end face 58 on the projecting end of member 14. The juncture of face 58 with the annular peripheral portion of projection 40 forms a cam follower for insuring the proper angular orientation between members 12 and 14 and thereby the recess surfaces with the projection surface to form guide means for the members and contacts to insure their proper engagement.

As will be seen from FIGS. **2*a*–2*e*, the projection 40 on plug member 14 may be inserted into the receptacle member recess 22 at a variety of different angles, as for example shown in FIGS. 2*a* and 3*a* at 180° out of alignment with pin contacts 18 disposed above the horizontal mid plane bisecting the members and contacts 26 below the plane. The juncture or corner of front face 58 and the peripheral axially extending circumferential surface portion or annular portion of projection 40 engages the cam portion or cam 46 intermediate the cam ends. As axial pressure is applied between the members 12 and 14, the plug member 14 in order to move forward into the recess 22 must rise along the cam 46. Since the projection 40 is prevented from fully entering the recess 22 in the position shown in FIGS. 2*a* and 2*b*, the member 14 must rotate relative member 12 as shown in FIGS. 2*b*, 2*c*, 3*b* and 3*c* to permit the projection 40 to both rise and move forward into recess 22**.

The rotation and axial movement indicated at *x* and *x'* in FIGS. **2*c* and 2*d* brings the semi-circular or cylindrical portion of plug member 14 into closer angular alignment with the semi-circular or annular portion of the recess 22 with surfaces 50 and 56 in angular alignment, and when the flat surface portions 50 and 56 are in angular alignment, as shown in FIGS. 2*d* and 3*d*, resistance to forward or axial movement is eliminated and the recessed or blind contacts 18 and 26 are in angular alignment to permit their engagement in response to further axial pressure between members 12 and 14. The cam 46 is then brought into abutment with ramp portion 54 to terminate further axial movement. Rotation as indicated in FIGS. 2*e* and 3*e* may be in either direction to secure alignment with rotation naturally occurring in the direction of least resistance. The lip 36 is, of course, simultaneously engaged in recess 38. To withdraw the plug member 14 from the receptacle member 12, the two are simply axially separated to disengage lip 36 from recess 38 and as the face 58 is axially aligned with the rearward end of cam 46, the plug member 14 may be rotated or allowed to move downward along cam 46** to easily retract or separate the members.

It will be appreciated that the connector bodies 12 and 14 are usually of rubber and while not shown, a protective annular metal skirt is often provided about the tubular portion of contact 26. When pressure is applied to engage the contacts, the rubber may yield and the metal parts can score or otherwise damage the rubber or the contacts may be pushed backward in their passageways unless the described accurate alignment or guide means is provided for controlling the contact alignment and ensure their proper engagement.

The connector bodies or members 12 and 14 are also each provided with peripheral recess 60 intermediate their ends in which a peripheral lip 62 at one end of a respective connector boot 64 is received. The connector boot is formed of flexible rubber and is folded back as indicated by dashed lines 66 in FIG. 5 for facile receipt over a reduced peripheral portion at the end of the respective connector body. When the boot 64 butts against a stop shoulder 68 on the body, the folded back portion 66 is simply rolled over the shoulder and the lip 62 automatically engages the recess 60 to provide a tight moistureproof seal with the corresponding connector body end.

The other or rear end of the boot has a thick peripheral annular shoulder portion 70 from which a conical end surface portion 72 extends radially inwardly and axially rearwardly to a small diameter opening or passageway 74 for receiving the several insulated conductors 20 or 30, for example, connected to the contacts in the respective body and carried in a conventional jacket 76 of insulating material. A plurality of spaced peripheral projections 78 are formed on the inner surface of the conical portion 72 between the shoulder 70 and the rear passageway 74 and each projection has a respective different diameter.

The conductors are assembled to the contacts usually before the boot 64 is placed on the connector body. The conical portion 72 at the rear end of the boot is pushed in or inverted by axial translation forwardly in response to axial pressure supplied, for example, by the contacts and attached conductors or by the conductors alone before connection to the contacts as shown by dashed lines 80 in FIG. 5 to an axial position adjacent the shoulder 70. Shoulder or thickened wall portion 70 is located intermediate the ends of boot 64 so that it is spaced radially and axially from the connector body and from the passageway 74 and provides increased resistance to deformation so that the portion 72 inverts in response to axial pressure thereagainst by the conductor or contact ends and forms a guideway for the contacts and conductors to move through the passageway 74. The guideway portion indicated at 80 now provides little radial resistance to expansion in response to the insertion of the contacts and conductors and jacket 76 through the passageway 74 whereby the diameter of the passageway enlarges to pass the conductors. Thereafter, rearward movement or axial retraction of the folded concial portion to the position shown by dashed lines 82 in FIG. 5 provides a tight grip on the jacket and conductors. The edge of passageway 74 and annular projections 78 resiliently contract radially inwardly around the conductors 20 or 30 and jacket 76 with the projections 78 gripping the jacket 76 to provide a tight seal against moisture, for example.

The foregoing constitutes a description of one improved connector assembly incorporating the principles of the present invention, whose principles are believed not limited to the foregoing description and which are believed set forth in the accompanying claims.

What is claimed is:

1. An electrical connector assembly for connecting each contact of one plurality of contacts with a respective contact of another plurality of contacts comprising:

a first connector body having a longitudinal axis with a plurality of axially extending passageways extending parallel to said axis and receiving a respective contact of said one plurality of contacts, said body having an annular wall at one end with an internal surface of said wall defining an encircled axially extending recess open at said one end with said one plurality of contacts extending parallel to the axis of said body into said recess and spaced from said one end;

a second connector body having a projecting front portion with a front end received in said recess and a longitudinal second body axis with a plurality of passageways extending parallel to said second body axis and receiving a respective contact of said other plurality of contacts said other plurality of contacts each terminating in said projecting front portion of said second body and spaced from said front end of said second connector body for engagement with a respective contact of the first plurality of contacts;

cam means on one of said connector bodies; and cam follower means on the other connector body for engagement with the cam means on the one connector body in response to the receipt of said projecting front portion in said recess and axial pressure between said bodies to rotate the bodies relative one another to a predetermined angular position and angularly align each contact of the first plurality of contacts with a respective contact of the other plurality of contacts for engaging each contact of said one plurality of contacts with a respective contact of said other plurality of contacts.

2. The connector assembly claimed in claim 1 in which said cam means includes a first ramp surface portion formed in said recess on the internal surface of said annular wall with said ramp surface portion terminating intermediate the opposite axial ends of said recess and extending transversely to the longitudinal axis of said first connector body at an angle of less than 90°.

3. In the connector assembly claimed in claim 2, a first flat surface portion formed in said recess on the internal surface of said annular wall extending parallel to the longitudinal axis of said first body from one end of said ramp surface portion toward the end of said first connector body opposite said one end.

4. The connector assembly claimed in claim 3 in which said cam follower means includes the juncture of a radially extending front face at the front end of said second connector body and a peripheral axially extending arcuate surface portion on the projecting portion of said second connector body.

5. In the connector assembly claimed in claim 4, in which said projecting front portion has a flat surface portion parallel to the longitudinal axis of said second connector body and intersecting both said peripheral axially extending arcuate surface portion and said radially extending front face for engagement with the first flat surface portion formed in said recess, and a second ramp surface portion formed on said second connector body at an angle transverse to the longitudinal axis of said second body and corresponding to the angle of the first ramp portion for engagement with said first ramp surface portion on the internal surface of said annular wall.

6. The connector assembly claimed in claim 1 in which said second connector body is integrally formed in one piece and the passageways in said second connector body for receiving a respective one of said other plurality of contacts each have a reduced diameter portion spaced adjacent the end of said second connector body opposite said front end and each contact of said other plurality of contacts has a contact radial face at one end of each contact of said other plurality of contacts with each contact radial face of larger diameter than said reduced diameter portion, and each passageway in said second connector body has an enlarged diameter passageway portion formed between each small diameter portion and said opposite end of said second connector body and in communication with the respective reduced diameter portion for aligning and guiding the radial face of the respective contact of said other plurality of contacts through the respective reduced diameter portion of the respective passageway.

7. In the assembly claimed in claim 1, an elongate annular boot of flexible rubber material having one end for receipt either over the end opposite said one end of said first body and over the end opposite said front end of said second connector body;

said boot having a free conical end portion extending radially inwardly and axially from said other end to define a reduced diameter passageway; and a shoulder formed intermediate the ends of said boot with said shoulder spaced radially from each connector body and axially from the reduced diameter passageway to provide an area of increased resistance to deformation on said boot whereby said conical portion is axially translated toward the other end of said either one of said bodies to provide a guideway enabling enlargement of said passageway for receiving a plurality of conductors connected to respective contacts carried by said either one of said bodies.

8. An electrical connector assembly for connecting each contact of one plurality of contacts with a respective contact of another plurality of contacts comprising:

a first connector body having a longitudinal axis with a plurality of passageways extending parallel to said axis and receiving a respective contact of said one plurality of contacts, said body having an annular wall at one end with an internal surface defining an encircled axially extending recess open at said one end with said one plurality of contacts extending parallel to the axis of said body into said recess and spaced from said one end;

a second connector body having a front end received in said recess and a longitudinal axis with a plurality of passageways extending parallel to said axis and receiving a respective contact of said other plurality of contacts, said other plurality of contacts each terminating at a position in said second body spaced from said front end of said second connector body for engagement with a respective contact of the first plurality of contacts;

cam means integrally formed on the internal surface of said annular wall; and cam follower means on the front end of the second connector body for engagement with the cam means on the internal surface of said annular wall in response to the receipt of said second connector front end in said recess and the application of axial pressure between said bodies to rotate said second connector body relative the first connector body to a predetermined angular position and angularly align each contact of the first plurality of contacts with a respective contact of the other plurality of contacts for engaging each contact of said one plurality of contacts with a respective contact of said other plurality of contacts.

* * * * *